United States Patent [19]

Redington

[11] Patent Number: 4,469,132

[45] Date of Patent: Sep. 4, 1984

[54] DAMPER APPARATUS

[75] Inventor: Gordon F. Redington, St. Paul, Minn.

[73] Assignee: McQuay Inc., Minneapolis, Minn.

[21] Appl. No.: 392,945

[22] Filed: Jun. 28, 1982

[51] Int. Cl.³ ..... F24F 13/16; F16K 1/226

[52] U.S. Cl. ..... 137/601; 49/91; 98/110; 251/306

[58] Field of Search ..... 137/601, 306; 251/305, 251/357; 98/110, 121 R, 40 V; 49/91, 496

[56] References Cited

U.S. PATENT DOCUMENTS

| | | | |
|---|---|---|---|
| 3,084,715 | 4/1963 | Scharres | 137/601 |
| 3,531,897 | 10/1970 | Weimar | 49/496 |
| 3,547,152 | 12/1970 | Hess | 137/601 |
| 3,706,165 | 12/1972 | Baldrich | 49/91 |
| 3,724,812 | 4/1973 | Richardson | 251/306 |
| 3,771,559 | 11/1973 | Alley | 137/601 |
| 3,783,768 | 1/1974 | Caming et al. | 98/110 |
| 4,253,492 | 3/1981 | Sullivan | 137/601 |

FOREIGN PATENT DOCUMENTS

| | | | |
|---|---|---|---|
| 1080022 | 6/1980 | Canada | 137/601 |
| 2648519 | 3/1978 | Fed. Rep. of Germany | 251/306 |

*Primary Examiner*—Martin P. Schwadron
*Assistant Examiner*—Stephen M. Hepperle
*Attorney, Agent, or Firm*—Merchant, Gould, Smith, Edell, Welter & Schmidt

[57] ABSTRACT

A damper assembly for controlling the flow of fluid through a passageway is disclosed. The damper assembly comprises a rectangular frame (22) adapted to be fitted in a passageway. A plurality of damper blades (24) are supported for pivotal motion in the frame (22) about spaced, parallel longitudinal axes (26) between opened and closed position. The blades (24) are operatively interconnected by a linkage mechanism (28) so as to be substantially simultaneously rotated as required. Operative means including a drive shaft (30) suitably attached to one or more of the blades (24) is provided for rotating the blades between opened and closed positions.

19 Claims, 14 Drawing Figures

FIG. 1
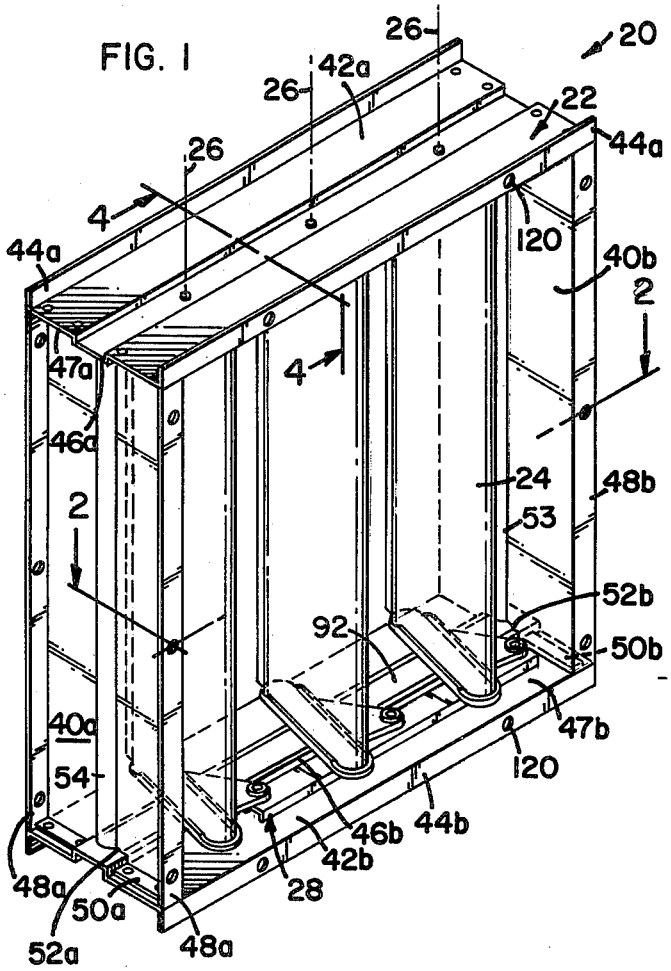
FIG. 9A
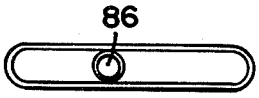
FIG. 9B
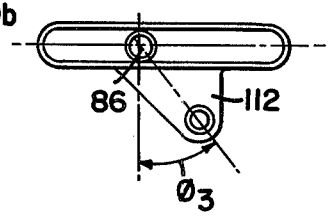
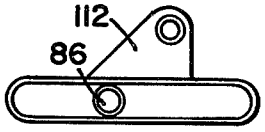
FIG. 9C
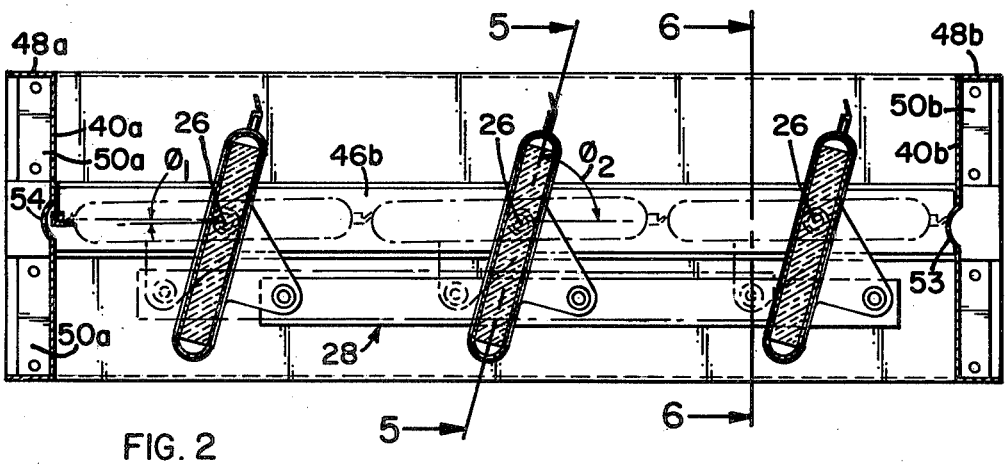
FIG. 2

FIG. 3
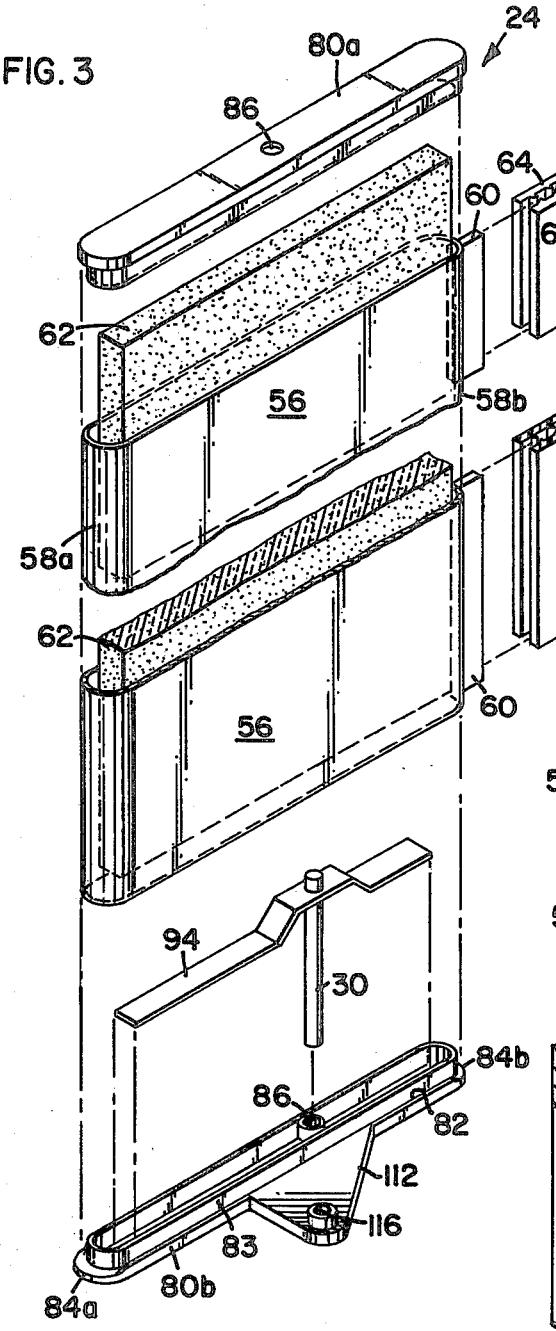
FIG. 12
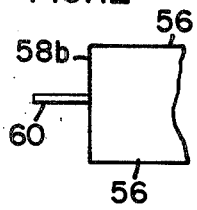
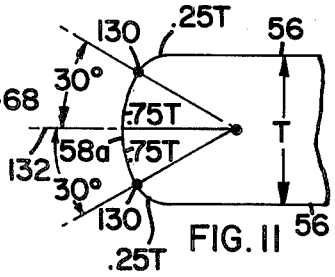
FIG. 11
FIG. 10
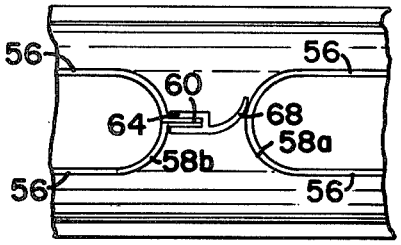
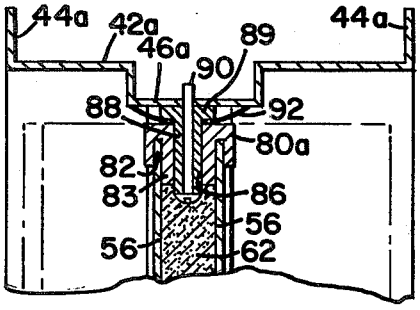
FIG. 4

FIG. 5
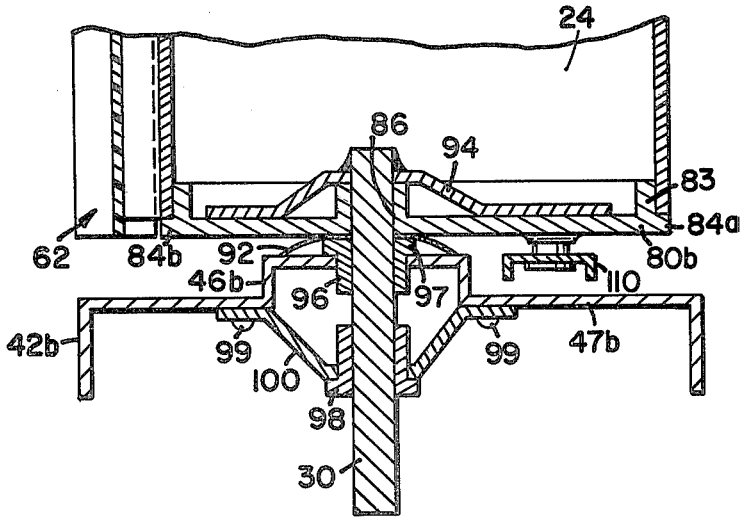
FIG. 6
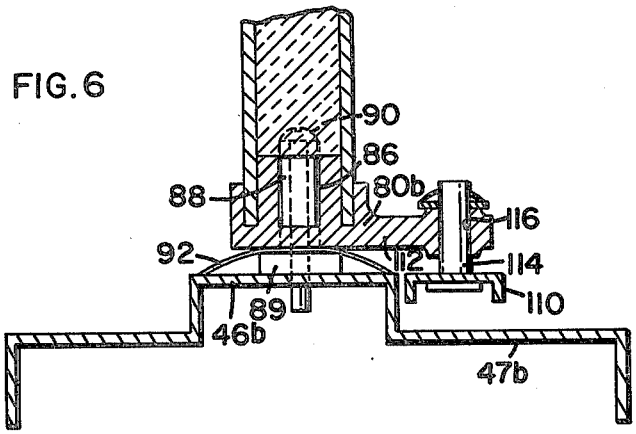
FIG. 7
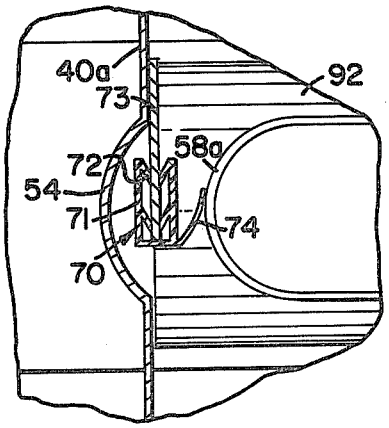
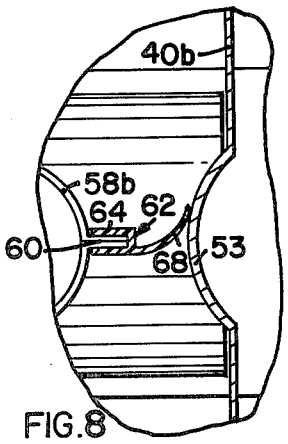
FIG. 8

DAMPER APPARATUS

TECHNICAL FIELD OF THE INVENTION

The present invention relates to a damper assembly for controlling the flow of fluid through a passageway. More particularly, the present invention relates to improved structures for providing a damper assembly which is sealed when in a closed position and furthermore to improvements to the mounting structure of the blade assembly.

BACKGROUND OF THE INVENTION

Air control dampers are well known in the art. However, many of the dampers in use today were developed when the cost of energy was low. Consequently, there was less of a requirement for the dampers to seal tightly when in a closed position. With the rising energy costs, various seals and modifications have been made to existing damper systems in an effort to reduce fluid flow leakage.

Most of the seals and modifications rely on precise alignment of the various working parts. Unfortunately, manufacturing procedures often do not produce parts satisfying the degree of alignment required. In addition, precise alignment often depends on the assembly skills of those installing the systems. Consequently, once installed, damper systems often have leakage rates which are much greater than expected.

An example of current damper assemblies is U.S. Pat. No. 3,084,715 to Scharres which discloses damper blades having compressible hollow edges. For proper operation, the blades are preferably in an "opposed blade" arrangement wherein the blades are aligned edge to edge. Thus, the blades must be carefully installed so they are aligned edge for edge upon completion of the pivoting motion.

In yet another example of current damper systems, U.S. Pat. No. 3,547,152 to Hess discloses a damper having hollow rectangular blades with flexible, inflatible tubes along the edges or tips thereof. Once again, the blades are preferrably in an "opposed blade" position so as to provide an airtight seal when the damper assembly is closed. Furthermore, the ends of the blades include moveable extensions which require air pressure so as to be forced outwards against the damper side frame to effectuate a seal.

U.S. Pat. No. 3,771,559 to Alley also discloses the edges of the damper being forced into an "opposed position" so as to provide an effective seal when the damper assembly is closed. In addition, the blades are shown as having structural members on the inside thereof which make it difficult to insulate the blades so as to conserve even more energy.

The present invention solves these and many other problems associated with current damper systems.

SUMMARY OF THE INVENTION

The present invention relates to a damper assembly for controlling a flow of fluid through a passageway. The damper assembly of the present invention includes a frame defining a generally rectangular opening of predetermined width and height, the frame being suitably mounted in the passageway. A plurality of hollow, generally rectangular blades having somewhat rounded first and second edges, are pivotally mounted at first and second ends on the frame for pivotal movement about substantially parallel axes between a closed position wherein the blades are in a somewhat continuous contact with one another to an opened position wherein the blades lie in generally spaced parallel planes. The second edge of the blades has a flanged portion adapted for attachment of flexible seal means whereby the first and second edges of adjacent blades make contact and cooperate with each other in said closed position to prevent any fluid flow between the first and second edges. End cap means are positioned proximate the first and second ends of the blades for supporting the blades on the frame. The end cap means cooperate with the frame to provide a fluid-tight seal between the first and second ends of the blades and the frame when the blades are in the closed position. Drive shaft means transfer power from an external source of power to the blades, whereby the blades can be driven between the opened and closed positions. Linkage means interconnect the blades, whereby the blades are pivoted substantially simultaneously between the opened position and the closed position.

The present invention is particularly advantageous because it provides a damper assembly which can be readily and quickly assembled, and when so assembled the various components will be in the required working relationship to one another without necessitating further adjustments for selective assembly by skilled assemblers. The easy assembly and efficiency of the present invention is the result of a number of factors. The one piece end cap structure of the present invention provides several functions to as to reduce the number of parts required for installation and to enhance the accuracy or precision of the installation.

In addition, the present invention provides a very rigid damper blade which allows for the use of longer length damper blades thus eliminating the need for intermediate blade supports on many damper blade sizes. Eliminating the need for intermediate supports reduces the number of blades, eliminates the connection and alignment problems between these blades, and eliminates the problem of seal leakage at the intermediate support.

In addition, the present invention offers a rigid damper blade assembly suitable for operation in high fluid pressures because of the resultant reduced deflection of the blades. In addition, the streamlined blades of the present invention make for a damper assembly which has a low fluid pressure drop and creates minimum turbulence.

Yet another feature of the present invention is the provision of a rigid damper blade which can be driven at its very end, with the opposite end of the blade remaining in alignment despite the forces resulting from bearing friction at the blade ends, fluid forces and seal drag. In addition, the interconnecting linkages between blades are effectively positioned out of the fluid stream to eliminate them as a source of fluid resistance and air noise.

A further advantage of the present invention is the provision of a damper blade that can be easily insulated by the insertion of core insulation.

Still yet another advantage of the present invention is the provision of a blade seal that has overtravel capability in the closed position. The overtravel capabilities will allow a blade to seal along its entire length in spite of distortions or twists in the blade that might bring one portion of the blade seal in contact with its mating surface before some other portion. Furthermore, the unique seal features of the present invention make for a damper that requires only a slight force to close the damper to the sealed position. This is in contrast to other designs wherein the tightness of the seal is dependent upon the amount of closing force. Furthermore, the seal mechanism of the present invention utilizes the force of the air pressure to cause the seal mechanism to tighten rather than unseat itself. Additionally, the seal can be easily replaced.

These and various other advantages and features of novelty which characterize the invention are pointed out with particularity in the claims annexed hereto and forming a part hereof. However, for a better understanding of the invention, its advantages, and object obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views, FIG. 1 is a view in perspective of the present invention;

FIG. 2 is a sectional view along line 2—2 of FIG. 1;

FIG. 3 is an exploded fragmentary view in elevation of a blade of the present invention;

FIG. 4 is a view along line 4—4 of FIG. 1 when the blades are in a closed position;

FIG. 5 is a view along line 5—5 of FIG. 2 of a blade in the opened position and operatively connected to a drive shaft;

FIG. 6 is a view along line 6—6 of FIG. 2 of a blade in the closed position and mounted on a bearing structure;

FIG. 7 is an enlarged fragmentary sectional view of a flexible seal apparatus mounted on a frame side member;

FIG. 8 is an enlarged fragmentary sectional view of an arcuately-shaped raised portion on a frame side member;

FIGS. 9A through 9C are top plan views of three embodiments of an end cap structure embodying the principles of the present invention;

FIG. 10 is an enlarged fragmentary plan view of the side edges of two blades sealingly engaging each other;

FIG. 11 is a diagramatic view of the radius of curvature of one embodiment of the curved blade edge; and FIG. 12 is a fragmentary view of an alternate embodiment of the flanged blade edge.

DETAILED DESCRIPTION OF THE PRESENT INVENTION

A damper assembly embodying the principles of the present invention and generally designated by the reference number 20, is illustrated in FIG. 1. The present invention is illustrated in FIG. 1 as embodying a damper assembly of the type suitable for use in fluid distribution, ventilating, conditioning, pneumatic conveying, etc. where it is necessary to control the flow of fluid through a duct or similar passageway.

In general, the damper assembly comprises a rectangular frame 22 adapted to be fitted in a duct or passageway so as to define a rectangular opening through which fluid passes when the damper assembly is open. The frame is shown as supporting a plurality of damper blades 24 for pivotal motion about spaced, parallel longitudinal axes 26 between opened and closed positions as illustrated in FIG. 2 wherein doted lines represent the closed blade position and solid lines represent the opened blade position. While the blades of the embodiment illustrated, are shown as mounted for pivotal motion about vertical pivots, it will be understood that the blades may be arranged with the spaced, longitudinal axes about which they pivot being horizontally disposed, if so preferred. It will be appreciated further that a single blade 24 might be utilized with frame 22.

The blades are illustrated as all being of the same general configuration, however, it will be understood that the damper assemblies may be of varying sizes so as to have application to varying sizes of passageways and uses. In addition, to enable use with ducts or passageways of nonstandard sizes, the present invention provides for the use of blades of varying width within a single frame. Furthermore, while the damper assembly is illustrated as being one blade high, it will be appreciated that the damper assembly may be of multiple blade heights with the blades suitably stacked on top of each other. As mentioned, the blades of a damper system embodying the principles of the present invention may be pivoted from a generally contiguous edge-to-edge closed position, roughly perpendicular to the direction of fluid flow through the passageway, to a fully opened position in spaced parallel planes generally parallel to the flow. As illustrated in FIG. 2, when in the closed position, the blades will preferably lie in planes slightly oblique with respect to a plane extending transversely of the damper opening. In a preferred embodiment, an angle of intersection $\theta_1$ between a blade's center line and the plane extending transversely of the damper opening will be from 1 to 2 degrees. In addition, the blades may be turned to different intermediate, partially opened positions providing for different total flow areas through the opening of the damper assembly. Furthermore, in certain embodiments as illustrated in FIG. 2, when in the fully opened position, the blades might lie in planes oblique with respect to the flow of fluid. In the preferred embodiment shown, an angle $\theta_2$ of 75 degrees between a blade's center line and the plane extending transversely of the damper opening has been found to be effective to maintain a proportional relationship between blade angular change and fluid flow changes.

In the embodiment illustrated in FIG. 1, all the blades 24 are operatively interconnected by a linkage mechanism 28, hereinafter described, so as to be substantially simultaneously rotated as required. Operative means for rotating the blades is shown in FIG. 5 as including a drive shaft 30 suitably attached to one or more of the blades 24. Drive shaft 30 may, in turn, be driven by any suitable mechanism such as a motor actuated in response to change in temperature, changes in velocity, or any other type of signal or combination thereof. It will be further appreciated, that any of the blades 24 or any combination thereof may be driven by drive shafts 30. In addition, the linkage 28 may be directly driven by a drive mechanism so that none of the blades need be directly connected to a drive shaft.

By reason of the novel features of the present invention, damper assembly 20 is particularly efficient in operation in that it imposes minimum resistance to fluid flow when the blades 24 are in an opened position and conversely it provides a fluid-tight seal across frame 22 when blades 24 are swung to a closed position, thereby prohibiting the flow of fluid through a passageway. In addition, the present invention reduces the number of working parts and assembly time required to construct a damper assembly. Furthermore, the degree of precision required for assembly is reduced, thereby correspondingly reducing the expertise level and amount of effort required to assemble the present invention. In addition, the present invention provides a damper assembly with a long, useful life and high efficiency even as the various parts are subjected to wear through extended use by reducing the precision required, providing efficient operation even if some misalignment does occur, providing for easy replacement of worn parts, etc.

In particular, as illustrated in FIG. 1, the frame 22 includes spaced, parallel side members 40*a,b* suitably fastened at their upper and lower ends to spaced, parallel top and bottom members 42*a,b* so as to define a generally rectangular damper opening. Typically, the frame members will be made from a metal material with various methods for attaching the frame members being utilized, for example, spot welds, metal screws, rivets, adhesives, etc.

The members 42*a,b* comprise channel-shaped elongated members with the channels facing outwardly from the damper opening such that a raised portion 46*a,b* with a generally flat inside surface faces the damper opening as does two relatively flat recessed surfaces 47*a,b* located on either side of the raised portions 46*a,b*. In addition, members 42*a,b* have integral flanges 44*a,b* along the sides thereof shown here as extending away from the damper opening.

As illustrated in FIGS. 1 and 2, the members 40*a,b* also include flanges 48*a,b* along the sides thereof which extend away from the damper opening. In addition, the members 40*a,b* include horizontally extending spaced flanges 50*a,b* near the top and bottom ends thereof for attachment of the side members 40*a,b* to the top and bottom members 42*a,b*. Furthermore, the side members 40*a,b* define vertically oriented indentations 52*a,b* near the ends thereof so as to cooperate with the raised portions 46*a,b* to assure a proper fit of the frame members.

When the frame members are suitably fastened, flanges 50*a,b* rest on the recessed portions 47*a,b* of top and bottom members 42*a,b* and indentations 52*a,b* rest on raised portions 46*a,b*.

As illustrated in FIG. 2, side member 40*b* has embossed therein an arcuately shaped raised portion 53 extending longitudinally thereof and protruding towards the damper opening. Side member 40*a* has embossed therein an arcuately shaped recessed portion 54 extending longitudinally thereof so as to form an arcuately shaped channel facing the damper opening.

All of the blades 24 are substantially identical in plan configuration and cross section. As illustrated in FIG. 3, each blade 24 comprises two generally rectangular side wall members 56, disposed in generally spaced parallel planes and interconnected by two arcuately shaped edges 58*a,b* so as to be substantially hollow. Blades 24 are preferably configured so as to be symetrical on either side of a plane interconnecting edges 58*a,b*.

In one preferred embodiment, blades 24 are made from a single rectangular piece of sheet metal folded upon itself so as to form the required blade configuration. The sheet metal is spot welded or suitably attached at the ends thereof so as to form a flanged portion 60 at the edge 58*b*. In this manner, a blade having relatively thin walls and the required structural integrity is derived. Consequently, the blades 24 are structurally rigid and not prone to twisting or deflecting and yet are of relatively light weight.

In a typical application, blades 24 are of much greater height than width. A one-inch thick blade of light sheet metal has been found satisfactory in certain applications of ten-foot high blades.

The ends of blades 24 are open before assembly and thus easily accessible for insulating. In addition, there are no structural members on the inside of the blades to hinder the insertion of insulation. Core insulation 62 or other suitable insulation material may be, as illustrated in FIG. 3, readily inserted into the interior of blades 24. Thus, the present invention is particularly advantageous in those applications wherein there is a temperature difference across the damper assembly when in a closed position. A damper assembly with good insulating qualities will aid in conserving energy and reducing the formation of frost or condensation in the face of such temperature differentials.

As illustrated in FIG. 3, attached to the flanged edge 60 is a seal apparatus 62 which is preferably a unitary piece made from a dual durometer vinyl extrusion process. Apparatus 62 includes a somewhat rigid channel shaped member 64 with internally extending projections or barbs 66. The member 64 is adapted for being placed over the flanged portion 60 with the projections 66 engaging the outer surface of the flanged portion 60 so as to retain the seal apparatus on the blade 24. Integrally attached to channel shaped member 64 at the outer edge thereof is a flexible blade-like member 68. Preferably, blade-like member 68 is attached to the corner of member 64 which leads in the direction of rotation when rotating the blades to a closed position.

The seal apparatus 62 is located along the longitudinal extent of the blade edge 58*b* so as to wipe or lick against the edge 58*a* of an adjacent blade 24 as illustrated in FIG. 10 when in the closed position thereby effectuating a fluid-tight seal between adjacent blades. It will be appreciated, that as illustrated in FIG. 12, the flanged edge 58*b* need not be rounded since it is the seal apparatus 62 which makes contact with the edge 58*a*. The relationship between the seal 62 and the adjacent blade edge 58*a* which has a generally smooth and gradual radius of curvature is such that a sealing relationship between the blades 24 will be formed even if there is over travel of the blades and the blades do not precisely line up edge for edge. Therefore, if twisting of the blades should occur or if there is misalignment between the blades such that one closes ahead of the other, the seal apparatus 62 of the present invention will still provide for a fluid tight seal between the adjacent blades.

In one embodiment as illustrated in FIG. 11, a major portion of the curved edge 58*a* has a radius of curvature which is 0.75 that of the blade thickness (T). However, near the edges of the curved edge 58*a*, the radius of curvature is decreased to roughly 0.25 that of the blade thickness (T). As illustrated in FIG. 11, the radius of curvature changes at locations 130 on the curved edge 58*a* at approximately 30 degrees of arc, on either side of a center line 132 extending through the center of the blade. The large gradual radius of curvature portion near the center of the curved edge 58*a* assures that adequate sealing between adjacent blades will occur even though there may be some misalignment of the blade edges. The reduced radius of curvature portions interconnecting the large radius of curvature portion with the straight portion of the blade assure that the curved edge 58*a* projects a sufficient distance from the blade to enable engagement with the cooperating seal apparatus 62 and prevent the seal apparatus from making contact with the straight portion or side walls of the blade when the blades are pivoted into a closed position.

As illustrated in FIGS. 2 and 8, the blade 24 whose seal 62 is adjacent the side member 40*b* will form a fluidtight seal with the side member 40*b* when in the closed position. Seal 62 will sealingly engage raised section 53 when the blade is pivoted to the closed position. In addition, as illustrated in FIGS. 2 and 7, a seal strip structure 70 is suitably asttached to member 40*a* along the longitudinal extent thereof such that the edge 58*a* of the adjacent blade will make contact therewith so as to form a fluidtight seal when the damper asembly is in the closed position. Seal strip 70 is preferrably made from a dual durometer vinyl etrusion process and includes a somewhat rigid channel shaped member 71 with internally extending projections or barbs 72. Member 71 is adapted for releasably attaching to a member 73 which is suitably attached to member 40*a*. Attached near the end of member 71 and projecting generally inwardly toward the damper opening is a blade-like member 74 which makes contact with the edge 58*a* when the blades 24 are in a closed position.

As illustrated in FIG. 3, the blades 24 have end piece elements 80*a,b* releasably attached to the top and bottom ends thereof respectively. In the preferred embodiment shown in FIGS. 3 and 4, end piece elements 80*a,b* have two parallel spaced slots or grooves 82 adapted for receipt of the blade side walls 56 so as to support the blade walls 56. A generally rectangular shaped member 83 with generally rounded edges, forms the inner walls of grooves 82. Member 83 has a configuration similar to that of blades 24 and extends a predetermined axial distance into blades 24 so as to provide additional support for the blade walls 56. Because the blade walls 56 are retained within grooves 82, no additional fastening of the blades to end pieces 80*a,b* is required. In addition, end pieces 80*a,b* have flanged rounded edges 84*a,b* configured similarly to rounded edges 58*a,b* of the blades 24. Rounded edges 84*a,b* provide additional support for the blade walls at the edges thereof and have an outer edge surface with the same general configuration as the outer edge surface 58*a,b* of the blades so as to form a blade assembly with a uniform outer surface.

As illustrated in FIG. 5, seal apparatus 62 preferably extends a predetermined distance beyond the ends of the blades 24. This distance is preferrably equal to the thickness of edges 84*a,b* such that the seal apparatus 62 engages the end piece 80*a,b* of an adjacent blade so as to form an airtight seal between adjacent end pieces 80*a,b* when the damper is in a closed position.

The end pieces 80*a,b* are preferably made of a single piece of plastic material in a unitary molding process, consequently, the end pieces are inexpensively and readily manufactured. Furthermore, the end pieces 80*a,b* assure proper alignment and configuration of blades 24 by utilizing a single part and not requiring a multiplicity of parts.

In addition to supporting the blades 24, the end pieces 80*a,b* provide a bearing structure for the pivotal mounting of the blades 24 on the frame 22. As illustrated in FIGS. 4 and 6, end pieces 80*a,b* define an aperture 86 adapted for receipt of a bearing structure 88 which is suitably attached to raised portions 46*a,b* of the frame top and bottom members 42*a,b* by a screw 90 or the like. Bearing structure 88 has a flanged portion 89 near one end thereof which provides a bearing surface for the end pieces 80*a,b* to pivot on thereby acting as a spacer to raise the end pieces 80*a,b* above the frame members so as to prevent binding of the end pieces with the frame members.

Usually one of the blades or a combination thereof will be operatively interconnected to the drive shaft 30 at one end thereof. As illustrated in FIGS. 3 and 5, the drive shaft 30 will extend through the aperture 86 of the end piece 80*b* at the end of the blades. An elongated member 94 or a shaft tab is suitably attached to the top end of the drive shaft 30 by welding or the like. Member 94 is suitably configured for resting within the inner cavity of end piece 80*b* defined by the oval member 83. Shaft tab is secured to end piece 80*b* by conventional methods such as suitable bonding or fasteners whereby the blade 24 is rigidly attached to drive shaft 30 and rotates therewith.

As illustrated in FIG. 5 a flanged bearing structure 96 is positioned within an aperature of raised portion 46*b* for receipt of shaft 30. Bearing structure 96 includes a flanged portion 97 for resting on raised portion 46*b* so as to act as a spacer between the end piece 80*b* and the raised portion 46*b*. In addition, as illustrated in FIG. 5, a second bearing structure 98, is positioned in an aperture of a generally V-shaped member 100 suitably attached to the bottom of frame member 42*b* by screws 99 or the like. Bearing structure 98 is positioned so as to be in alignment with bearing structure 96 thereby providing added support for drive shaft 30 which extends therethrough.

In addition, as illustrated in FIGS. 5 and 6, end pieces 80*a,b* also provide a bearing surface to wipe against an elongated end seal 92 positioned along the raised portions 46*a,b* of the frame member 42*a,b*. In one embodiment, the elongated end seal 92 is a replaceable stainless steel, spring-tempered elongated strip which is known in the art. The end seal 92 defines apertures therein for receipt of bearing structures 88 or the drive shaft 30 so as to allow placement between the end pieces 80*a,b* and raised portions 46*a,b*. End seal 92 forces against the bottom of the end pieces 80*a,b* thereby effectively forming a seal between the ends of the blades and the damper assembly frame.

Additionally, in one preferred embodiment, the end pieces 80*b* also provide an integral structure for linking the blades 24 with the linkage mechanism 28 and provide a bearing surface for pivotal attachment to an elongated rectangular linkage arm 110 of the linkage mechanism 28. In the embodiment illustrated in FIG. 1, all the blades are interconnected with the linkage mechanism 28 so as to be opened and closed substantially simultaneously even though only one of the blades 24 or any combination thereof is driven by a drive shaft 30. The end pieces 80*b* as illustrated in FIGS. 3 and 6, include an extension 112, integral therewith, extending generally outward from the side thereof. The extension 112 defines an aperture 116 adapted for receipt of a pivot pin 114 suitably attached to linkage arm 110.

Pivot pin 114 is pivotally mounted in aperature 116 such that as the end piece 80*b* pivots between an opened and closed position as illustrated in FIG. 2, the pivot pin follows an arcuate path between first and second positions. Correspondingly, the linkage arm 110, to which the pivot pin is attached, is made to move between first and second positions above the recessed portion 47*b*. As illustrated in FIGS. 9B and 9C, the integral side extesnsion 112 extend from either side of the end piece 80*b* and at varying angles. Thus, depending on the application, linkage arm 110 might be positioned on either side of the raised frame portion 46*b*. Typically, the linkage arm is positioned above the surface of recessed portion 47*b* so as to be at the same height or level as the raised portion 46*b*, thereby not interferring with fluid flow.

Correspondingly, the leading or flanged edge 58*b* of the blades can be made to point either into the fluid flow or in the direction of the fluid flow. Additionally, the blades can be made to pivot either clockwise or counter-clockwise, thereby providing for varying blade action.

Aperture 116 is positioned in integral extension 112 relative to the end piece pivot aperture 86 such that a line interconnecting their respective pivot axes, preferably intersects the center line of the end piece 80*b* at an angle $\theta_3$ of 45 degrees or less as illustrated in FIG. 9B. Thus, as the linkage arm 110 is moved from the closed to the opened position, the blades 24 travel through an arc $\theta_2$ of 90 degrees or less. Additionally, aperture 116 is sufficiently removed from the raised portion 46*b* of the frame member so that as the pivot pin 114 follows its arcuate path, the linkage bar 110 will not engage or bind with the raised portion as it reciprocates toward and away from the raised portion.

In certain applications, applicant has found an angle $\theta_3$ of approximately 37.5 degrees, which results in a blade stroke $\theta_2$ of 75 degrees, to be satisfactory.

As illustrated in FIGS. 9A through 9C, the apertures 86 in the end pieces 80*b*, are offset from the center of the blades to compensate for the addition of the seal apparatus 62 to the edges thereof. This enables the blades to be generally balanced about their pivotal axes, thereby eliminating rotational force resulting from the pressure of the controlled fluid. In certain applications, Applicant has found that offsetting the aperture 86 from the blade edges 58*a* and 58*b* by a ratio of 1.43 to 1 respectively is effective.

One method of assemblying the damper assembly 20 of the present invention is to first assemble the blades 24 and attach thereto the unitary end caps 80*a,b*. The bearing structures 88 are then attached to the horizontal frame members 42*a,b* for those blades which are not driven by the drive shaft 30. For the blade or blades 24 driven by the drive shaft(s) 30, the top end piece 80*a* is attached and the bearing structure 88 is attached to the top horizontal member 42*a*. However, the drive shaft 30 and its tab member 94 are positioned within the bottom end piece 80*b* and attached thereto prior to attaching the end piece to the blade. The sealing strip 92 is then positioned over the bearing structures 88 along the raised frame portions 46*a,b* of the top and bottom members 42*a,b*. The vertical side frame members 40*a,b* are next attached to the bottom member 42*b*. The blades 24 are then positioned in the frame on the bottom horizontal member 40*b* and the top horizontal member 40*a* is then attached.

The linkage arm 110 is attached to the extensions 112 of end pieces 80*b*. In one embodiment, apertures 120 in the frame 22 enable the assembly to be attached by screws or the like to a duct structure. It will, however, be understood that a damper assembly of the present invention is adaptable for attachment in varying ways.

Typically, the damper assembly might be attached to the end of a passageway to serve as an inlet, e.g. the suction side of a ventilation system, or as an outlet, e.g. the discharge side of a ventilation system. If the assembly is mounted on the interior of a passageway, angle iron or the like might be attached to the interior walls of the passageway and the damper assembly fastened thereto.

In operation, it will be appreciated that one or any combination of the blades 24 might be driven by the drive shaft(s) 30, however, the linkage 28 may be connected directly to a drive mechanism whereby none of the blades need be directly driven by a drive shaft. Typically, one blade will be driven by the drive shaft 30. As the blade 24 is made to pivot by the drive shaft, the other blades 24 are caused to pivot substantially simultaneously therewith due to the linkage apparatus interconnecting all of the blades.

The blades 24 pivot in the same direction, thereby providing for a parallel blade assembly operation as contrasted with an opposed blade operation. The parallel blade operation provides for rapid adjustment of the fluid flow and less linear disruption thereof during the opening or closing process. It will be appreciated, however, that the present invention might be utilized with an opposed blade assembly by incorporating a reversing linkage in the linkage structure 28 of the present invention.

It will be understood that even though numerous characteristics and advantages of the present invention have been set forth in the foregoing description, together with details of the structure and function of the invention, the disclosure is illustrative only and changes may be made in detail, especially in matters of shape, size and arrangement of parts within the principle of the invention, to the full extent indicated by the broad general meaning of the terms in which the appended claims are expressed.

What is claimed is:

1. A damper assembly for controlling a flow of liquid through a passageway, comprising:

(a) a frame mounted in said passageway defining a generally rectangular opening of predetermined width and height;

(b) a hollow, generally rectangular blade extending across said opening defined by said frame, said blade having a longitudinal axis and first and second ends and first and second side walls, said blade being pivotally mounted proximate said first and second ends on said frame for pivotal movement about said longitudinal axis between a closed position wherein said blade prevents the flow of fluid through said passageway and an open position wherein said blade allows the flow of fluid through said passageway;

(c) said blade having first and second longitudinal side edges, said first edge having a relatively large radius of curvature, said first edge including a central portion and first and second side portions interconnecting said central side portion to said first and second side walls respectively, said first edge having about a major portion thereof proximate said central portion a radius of curvature which is greater than one half the thickness of said blade, said first edge having a radius of curvature of less than one-half the thickness of said blade proximate said first and second side portions, said second edge having a flexible blade-like member removably interconnected thereto, said flexible blade-like member wiping said first edge of an adjacent blade when said blades are pivoted into said closed positions so as to prevent any fluid flow between adjacent blades when in said closed position;

(d) said frame having first and second sides, said first side having flexible seal means adapted for sealingly engaging said first edge of said blade when said blade is in said closed position, said second side having seal means for sealingly engaging said flexible blade-like member of said second edge of said blade when said blade is in said closed position; and (e) said blade including end cap means removably attached to said first and second ends of said blade, said end cap means providing a bearing surface cooperating with said frame to support said blade in said frame and prevent fluid flow between said end cap means and said frame when said blade is in said closed position, at least one of said end cap means including an integral radial extension for pivotal attachment of said blade to a drive linkage extending transversely of said frame, whereby transverse movement of said drive linkage results in pivoting of said blade between said opened and closed positions.

2. A damper assembly in accordance with claim 1, wherein each of said end cap means defines an aperture for reception of a bearing shaft about which said blade pivots, said bearing shaft at said first blade end includes means one half for rigidly attaching said blade and end cap means to said bearing shaft, whereby rotation of said bearing shaft about its longitudinal axis results in pivotal movement of said blade about its longitudnal axis between said closed and opened positions.

3. A damper assembly in accordance with claim 2, wherein said rigidly attaching means includes an elongated member extending radially from said bearing shaft, said elongated member being rigidly affixed to said bearing shaft so as to rotate with said bearing shaft, said elongated member being adapted for engagement of said end cap means when said shaft is rotated, whereby said blade is rotated with said bearing shaft.

4. A damper assembly in accordance with claim 1, wherein said end cap means defines a groove configured for reception of said blade ends, whereby said blade is rigidly retained within said groove, whereby necessitating no additional fastening of said blade to said end cap means.

5. A damper assembly in accordance with claim 1, wherein said end cap means includes a longitudinal extension adapted for insertion into said hollow blade a predetermined distance, said extension making contact with the inside surface of said blade, whereby said blade is rigidly retained by said end cap means.

6. A damper assembly in accordance with claim 1, wherein said end cap means is a unitary plastic end cap made from a unitary molding process, thereby reducing the number of mechanical parts required to construct said damper assembly.

7. A damper assembly in accordance with claim 1, wherein said second edge of said blade has a flanged portion adapted for releasible attachment of said flexible blade-like member.

8. A damper assembly for controlling a flow of fluid through a passageway, comprising:

(a) a frame defining a generally rectangular opening of predetermined width and height, said frame being suitably mounted in said passageway;

(b) a plurality of hollow, generally rectangular blades having first and second side walls and having first and second edges extending along the longitudinal extent thereof, said blades extending transversely across said opening defined by said frame, said blades having first and second ends, said blades being pivotally mounted on said frame proximate said first and second ends for pivotal movement about substantially parallel axes between a closed position wherein said first and second edges of adjacent blades are facing generally toward one another but are spaced apart, and an opened position wherein said blades lie in generally spaced parallel planes;

(c) said first edge of said blades being curvilinear and including a central portion and first and second side portions interconnecting said central portion to said first and second side walls respectively, said first edge having about a major portion thereof proximate said central portion a radius of curvature which is greater than one have the thickness of said blades, said first edge further having a radius of curvature less than one-half thickness of said blades proximate said first and second side portions, said second edge of said blades including a flexible blade-like member extending longitudinally thereof, said flexible bladelike member of said second edge having a greater width than the spacing between said second edges and said first edges of adjacent blades when said blades are in said closed position, said flexible blade-like member wiping said first edge of an adjacent blade when said blades are pivoted into said closed position to prevent any fluid flow between said first and second edges of adjacent blades;

(d) end cap means positioned proximate said first and second blade ends between said blades and said frame for supporting said blades, said end cap means cooperating with said frame to provide a fluid-tight seal between said first and second ends of said blades and said frame when said blades are in said closed position;

(e) drive shaft means for transferring power from an external source of power to said blades, whereby said blades can be driven between said opened and closed positions;

(f) linkage means interconnecting said blades whereby said blades are pivoted substantially simultaneously between said opened position and said closed position, said linkage means including an elongated member pivotally interconnected to at least one of said end cap means of each of said blades by an elongated control arm, said elongated member of said linkage means being offset from the axes of said blades and extending generally transversely of said frame; and (g) said frame including first and second sides, said first side including flexible seal means for sealingly engaging said first blade edge of the blade adjacent said first side when said blades are in said closed position, said second side including flexible seal means for sealingly engaging said flexible blade-like member of said second blade edge of the adjacent blade when said blades are in said closed position, whereby fluid flow between said blades and said frame sides is prevented when said blades are in said closed position.

9. A damper assembly in accordance with claim 8, wherein said second edge includes a flanged portion extending longitudinally thereof, said flexible blade-like member is attached to the end of a generally U-shaped member constructed and arranged for placement over said flanged portion, said generally U-shaped member including inwardly projecting members for engaging the surface of said flanged portion to retain said flexible blade-like member on said flanged portion.

10. A damper assembly in accordance with claim 9, wherein said flexible blade-like member and said U-shaped member are formed of a unitary molding process.

11. A damper assembly in accordance with claim 8, wherein said blades are mounted for rotation about longitudinally extending bearing shafts.

12. A damper assembly in accordance with claim 8, wherein said end cap means is a single piece formed of a plastic material during a unitary molding process, said end cap means defining an aperture adapted for insertion of a bearing shaft about which said blades are pivoted.

13. A damper assembly in accordance with claim 12, wherein said control arm is of one piece with said end cap means and defines an aperture radially removed from said bearing shaft aperture and adapted for reception of a shaft interconnecting said end cap means with said linkage means, whereby movement of said linkage means results in pivotal motion of said blades.

14. A damper assembly in accordance with claim 13, wherein said end cap means includes a longitudinally extending wall constructed for insertion a predetermined distance within said hollow blades, said wall making contact with the inside surface of said blade and retaining said blade in position on said end cap means.

15. A damper assembly in accordance with claim 14, wherein said drive shaft means includes a drive shaft fixably attached to a generally radially extending member, said member being adapted to fit into the interior space defined by said longitudinally extending wall, of said end cap means whereby upon movement of said drive shaft said radially extending member engages said end cap means and causes movement thereof, which in turn causes movement of said blades via said linkage means.

16. A damper assembly in accordance with claim 13, wherein said end cap means defines a groove adapted for insertion of said blades a predetermined distance, said groove supporting and retaining said blades in position relative to said end cap means.

17. A damper assembly for controlling a flow of fluid through a passageway, comprising:

(a) a frame defining a generally rectangular opening of predetermined width and height, said frame being suitably mounted in said passageway;

(b) a plurality of hollow, generally rectangular blades having first and second side walls and having first and second edges extending along the logitudinal extent thereof, said blades have first and second ends, said blades being pivotally mounted on said frame proximate said first and second ends for pivotal movement about substantially parallel axes between a closed position wherein said said first and second edges of adjacent blades are facing generally toward one another but are spaced apart, and an opened position wherein said blades lie in generally spaced parallel planes;

(c) said first edge being curvilinear and including a central portion and first and second side portions interconnecting said central portion to said first and second side walls respectively, said first edge having about a major portion thereof proximate said central portion a radius of curvature which is greater than one half the thickness of said blades, said first edge further having a radius of curvature less than one-half the thickness of said blades proximate said first and second side portions, said second edge of said blades including a flexible bladelike member extending longitudinally thereof, said flexible blade-like member of said second edge having a greater width than the spacing between said second edge and said first edge of adjacent blades when said blades are in said closed position, said flexible blade-like member wiping said first edge of an adjacent blade when said blades are pivoted into said closed positions as to prevent any fluid flow between adjacent blades when in said closed position;

(d) first and second means proximate said first and second blade ends respectively for supporting said blades in said frame, said first and second end support means providing a bearing surface for cooperating with said frame so as to provide a fluid-tight seal between said end support means and said frame when said blades are in said closed position;

(e) drive means for transferring power from an external source to said blades, whereby said blades can be driven between said opened and closed positions, said blades being interconnected by an elongated linkage arm extending transversely of said frame and being offset from the axes of said blades, said elongated linkage arm being pivotally interconnected to each of said first end support means; and (f) said frame including first and second sides said first sides having attached thereto seal means for sealingly engaging said first blade edge of the blade adjacent said first side when said blades are in said closed position, said second side including a seal means for sealingly engaging said flexible blade-like member of said second blade edge of the adjacent blade when said blades are in said closed position, whereby fluid flow between said blades and said frame sides is prevented when said blades are in said closed position.

18. A damper assembly in accordance with claim 17, wherein said first end support means further include an integral extension for suitable attachment of said first end support means to said elongated linkage arm.

19. A damper assembly for controlling a flow of fluid through a passageway, comprising:

(a) a frame defining a generally rectangular opening of predetermined width and height;

(b) a plurality of hollow, generally rectangular blades having first and second ends and first and second edges extending longitudinally between said first and second ends, said blades having open ends and first and second spaced side walls, said blades being pivotally mounted on said frame proximate said first and second ends for pivotal movement about spaced parallel axes between a closed position wherein said first and second edges of adjacent blades are facing generally toward one another but are spaced apart, and an opened position wherein said blades lie in generally spaced parallel planes;

(c) said first edge being curvilinear and including a central portion and first and second side portions interconnecting said central portion to said first and second side walls respectively, said first edge having about a major portion thereof proximate said central portion a radius of curvature which is greater than one half the thickess of said blades, said first edge further having a radius of curvature less than one-half thickness of said blades proximate said first and second side portions, said second edge including a flexible blade-like member extending longitudinally thereof, said flexible blade-like member of said second edge having a greater width than the spacing between said second edge and said first edge of adjacent blades when said blades are in said closed position, said flexible blade-like member wiping said first edge of said adjacent blade when said blades are pivoted into said closed position, said second edge having a flanged portion extending longitudinally thereof, said flexible blade-like member attached to a channel-like member having inwardly projecting members adapted for gripping said flanged portion upon placement of said channel-like member on said flanged portion;

(d) linkage means for interconnecting said blades, said linkage means including an elongated linkage arm extending transversely of said frame and being pivotably interconnected to each of said blades, whereby said blades are pivoted substantially simultaneously about said spaced parallel axes between said closed and opened positions by movement of said linkage arm;

(e) end cap means proximate said first and second ends of said blades, said end cap means having means for supporting said blades in said frame, said end cap means providing a bearing surface for sealingly engaging said frame when said blades are in said closed position, said end cap means defining a first aperture adapted for insertion of a bearing shaft, said end cap means proximate said first blade ends including an extension defining a second aperture radially removed from said first aperture and adapted for pivotal reception of a shaft-like member suitably connected to said linkage arm, said end cap means operatively interconnecting said blades to said linkage means;

(f) drive means for transmitting power from an external source to said damper assembly, said drive means including at least one of said bearing shafts being operatively interconnected to said external power source, and one of said end cap means, whereby upon rotation of said bearing shaft by said external power source said blades are made to rotate between said closed and opened positions; and (g) said frame including first and second sides, said first side having seal means for sealingly engaging said first blade edge of the blade adjacent said first side when said blades are in said closed position, said second side including seal means for sealingly engaging said flexible blade-like member of said second blade edge of the adjacent blade when said blades are in said closed position, whereby fluid flow between said blades and said frame sides is prevented when said blades are in said closed position.

* * * * *

UNITED STATES PATENT AND TRADEMARK OFFICE

CERTIFICATE OF CORRECTION

PATENT NO. : 4,469,132

DATED : September 4, 1984

INVENTOR(S) : Gordon F. Redington

It is certified that error appears in the above-identified patent and that said Letters Patent is hereby corrected as shown below:

Abstract, Line 7, delete "position" and insert --positions--.

Col. 1, line 40-41, delete "inflatible" and insert --inflatable--.

Col. 1, line 42, delete "preferrably" and insert --preferably--.

Col. 2, line 30, delete "to as to" and insert --so as to--.

Col. 3, line 14, delete "object" and insert --objects--.

Col. 3, line 48, delete "diagramatic" and insert --diagrammatic--.

Col. 4, line 2, delete "doted" and insert --dotted--.

Col. 5, line 59, delete "symetrical" and insert --symmetrical--.

Col. 7, line 11, delete "asttached" and insert --attached--.

Col. 7, lines 15 and 48, delete" preferrably" and insert --preferably--.

Col. 7, line 16, delete "etrusion" and insert --extrusion--.

Col. 8, lines 19 and 59, delete "aperature" and insert --aperture--.

Col. 8, lines 66-67, delete "extesnsion" and insert --extension--.

Col. 10, line 34, delete "liquid" and insert --fluid--.

UNITED STATES PATENT AND TRADEMARK OFFICE

CERTIFICATE OF CORRECTION

PATENT NO. : 4,469,132

DATED : September 4, 1984

INVENTOR(S) : Gordon F. Redington

It is certified that error appears in the above—identified patent and that said Letters Patent is hereby corrected as shown below:

Col. 11, line 28, delete "longitudnal" and insert --longitudinal--.

Col. 11, line 57, delete "releasible" and insert --releasable--.

Col. 12, line 16, delete" have" and insert --half--.

Col. 13, line 52, delete "logitudinal" and insert --longitudinal--.

Col. 13, line 57, delete "said".

On the front page of the Patent, the list of references cited should include the following U.S. patent documents and other documents:

U.S. Patent Documents:

| | | |
|---|---|---|
| 3,123,098 | 3/1964 | Bishop |
| 3,176,715 | 4/1965 | McGuown |
| 3,800,688 | 4/1974 | Parrish |
| 3,885,347 | 5/1975 | Adachi et al. |
| 3,908,529 | 9/1975 | McCabe |

UNITED STATES PATENT AND TRADEMARK OFFICE

CERTIFICATE OF CORRECTION

PATENT NO. : 4,469,132

DATED : September 4, 1984

INVENTOR(S) : Gordon F. Redington

It is certified that error appears in the above—identified patent and that said Letters Patent is hereby corrected as shown below:

Other Documents:

Brochure "New ARROW-MOD 1600 Series" Arrow Louver and Damper Corp.

Brochure "Storm Louver With Standard Frame" The Moore Company

Brochure "ARROW MOD AU-900 DAMPERS" Arrow Louver and Damper Corp.

Brochure "ARROW MOD 1400 Series" Arrow Louver and Damper Corp.

Signed and Sealed this

*Ninth* Day of *April 1985*

[SEAL]

*Attest:*

DONALD J. QUIGG

*Attesting Officer* *Acting Commissioner of Patents and Trademarks*